US011236284B2

(12) United States Patent
Oki

(10) Patent No.: US 11,236,284 B2
(45) Date of Patent: Feb. 1, 2022

(54) LUBRICATING OIL COMPOSITION

(71) Applicant: IDEMITSU KOSAN CO., LTD., Chiyoda-ku (JP)

(72) Inventor: Hiroshi Oki, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/495,415

(22) PCT Filed: Mar. 22, 2018

(86) PCT No.: PCT/JP2018/011281
§ 371 (c)(1),
(2) Date: Sep. 19, 2019

(87) PCT Pub. No.: WO2018/174126
PCT Pub. Date: Sep. 27, 2018

(65) Prior Publication Data

US 2020/0010774 A1 Jan. 9, 2020

(30) Foreign Application Priority Data

Mar. 23, 2017 (JP) ..... JP2017-057528

(51) Int. Cl.

| | |
|---|---|
| ***C10M 145/14*** | (2006.01) |
| ***C10M 169/04*** | (2006.01) |
| ***C10M 101/02*** | (2006.01) |
| ***C10N 20/02*** | (2006.01) |
| ***C10N 20/04*** | (2006.01) |
| ***C10N 20/00*** | (2006.01) |
| ***C10N 30/02*** | (2006.01) |
| ***C10N 30/06*** | (2006.01) |
| ***C10N 30/00*** | (2006.01) |
| ***C10N 40/25*** | (2006.01) |

(52) U.S. Cl.
CPC ..... *C10M 145/14* (2013.01); *C10M 101/02* (2013.01); *C10M 169/041* (2013.01); *C10M 2203/1025* (2013.01); *C10M 2209/084* (2013.01); *C10N 2020/019* (2020.05); *C10N 2020/02* (2013.01); *C10N 2020/04* (2013.01); *C10N 2020/071* (2020.05); *C10N 2030/02* (2013.01); *C10N 2030/06* (2013.01); *C10N 2030/54* (2020.05); *C10N 2030/68* (2020.05); *C10N 2040/25* (2013.01)

(58) Field of Classification Search
CPC ..... C10M 101/02; C10M 145/14; C10M 169/041; C10M 2203/1025; C10M 2209/084; C10N 2020/019; C10N 2020/02; C10N 2020/04; C10N 2020/071; C10N 2030/06; C10N 2030/54; C10N 2030/68; C10N 2040/25
See application file for complete search history.

(56) References Cited

U.S. PATENT DOCUMENTS

2010/0190671 A1† 7/2010 Stoehr

FOREIGN PATENT DOCUMENTS

| | | | | |
|---|---|---|---|---|
| CN | 101687963 | A | 3/2010 | |
| CN | 102498195 | A | 6/2012 | |
| CN | 106459821 | A | 2/2017 | |
| JP | 61-238891 | A | 10/1986 | |
| JP | 2010-532805 | A | 10/2010 | |
| JP | 2011-21056 | A | 2/2011 | |
| JP | 2011-21090 | A | 2/2011 | |
| JP | 2014-196518 | A | 10/2014 | |
| WO | WO 2016/043334 | A1 | 3/2016 | |
| WO | WO-2016043334 | A1 * | 3/2016 | ..... C10L 1/2364 |
| WO | WO-2017002969 | A1 * | 1/2017 | ..... C10M 141/12 |
| WO | WO 2017/002969 | A1 | 5/2017 | |

OTHER PUBLICATIONS

Office Action dated Dec. 17, 2019 in Japanese Patent Application No. 2017-057528.
"Hydroisomerized Base Stocks NEXBASE® 3030" NESTE, Edition 7.2, publication date unavailable, obtained on Nov. 22, 2019, 2 pages.
"Hydroisomerized Base Stocks NEXBASE® 3043" NESTE, Edition 5.2, publication date unavailable, obtained on Nov. 22, 2019, 2 pages.
International Search Report dated Jun. 26, 2018 in PCT/JP2018/011281 filed on Mar. 22, 2018.
Office Action in CN Application No. 201880019392.2, dated Aug. 24, 2021. (References AO, AP, and AQ are cited therein).
Office Action in JP Application No. 2017-057528, dated Aug. 31, 2021 (with English Translation).

(Continued)

*Primary Examiner* — Latosha Hines

(74) *Attorney, Agent, or Firm* — Oblon, McClelland, Maier & Neustadt, L.L.P.

(57) ABSTRACT

Provided is a lubricating oil composition containing a base oil (A) and a viscosity index improver (B) and satisfying the following requirements (I) and (II):

Requirement (I): a kinematic viscosity at 80° C., $V_{80}$ of the lubricating oil composition is 11.5 $mm^2/s$ or less;

Requirement (II): a ratio $[V_{80}/T_{80}]$ of a kinematic viscosity at 80° C., $V_{80}$ ($m^2/s$) to an oil film thickness measured at a sliding speed of 2.0 m/s, a maximum Hertz pressure of 0.8 GPa, and an oil temperature of 80° C., $T_{80}$ (nm) of the lubricating oil composition is less than 0.105 (($m^2/s$)/nm).

The lubricating oil composition is excellent in fuel saving properties and anti-wear properties even when it is used in a temperature environment of around 80° C. which is assumed to fall within a range where an engine is practically used.

9 Claims, No Drawings

(56) References Cited

OTHER PUBLICATIONS

Third Party Opinion in JP Application No. 2017-057528, dated Mar. 23, 2021, (Reference AX is cited therein).
"Surface Vehicle Standard", SAE International, Jan. 2015.
Office Action dated Nov. 4, 2020 in corresponding Japanese Patent Application No. 2017-057528 (with English Translation), 5 pages.
Neste Corporation, "Technical Data Sheet: Nexbase 3043", pp. 1-2, accessed Jun. 9, 2020, https://www.neste.com/sites/neste.com/files/attachments/tds_nexbase_3043.pdf.†
Neste Corporation, "Technical Data Sheet: Nexbase 3030", pp. 1-2, accessed Jun. 9, 2020, https://www.neste.com/sites/neste.com/files/attachments/tds_nexbase_3030.pdf.†

* cited by examiner
† cited by third party

LUBRICATING OIL COMPOSITION

TECHNICAL FIELD

The present invention relates to a lubricating oil composition.

BACKGROUND ART

In recent years, there has been a demand for efficient utilization of petroleum resources and reduction in emissions of carbon dioxide, so that fuel saving of vehicles such as automobiles is strongly demanded. Therefore, also for a lubricating oil composition to be used for an engine of vehicles such as automobiles, a demand for contributing to fuel saving is increasing.

For example, PTL 1 discloses a lubricating oil composition containing 0.1 to 50% by mass of a viscosity index improver having a predetermined weight average molecular weight and a kinematic viscosity/oil film thickness ratio at 25° C. of 0.2 or less in a lubricant base oil having a kinematic viscosity at 100° C. of 2.0 to 12 $mm^2/s$.

According to PTL 1, it is described that the lubricating oil composition described is low in kinematic viscosities at 40° C. and 100° C. and an HTHS viscosity (high-temperature high-shear viscosity) at 100° C. while retaining an HTHS viscosity at 150° C., and as a result, it is possible to exhibit sufficient fuel saving properties.

CITATION LIST

Patent Literature

PTL 1: JP 2014-196518 A

SUMMARY OF INVENTION

Technical Problem

In recent years, attention has been paid to improvement in fuel consumption performance at around 80° C. which is mainly assumed to fall within a range where an engine is practically used.

According to the study by the present inventors, it has been found that, with respect to the lubricating oil composition disclosed in PTL 1, the HTHS viscosity becomes low at around 80° C. which falls within the range of the practical use, and an oil film formed therefrom is difficult to retain the thickness, and therefore, the wear of the engine member is concerned.

The present invention has been made in view of the above problems, and an object of the present invention is to provide a lubricating oil composition excellent in fuel saving properties and anti-wear properties even when used in a temperature environment of around 80° C. which is assumed to fall within a range where an engine is practically used.

Solution to Problem

The present inventors have found that the above problem can be solved by a lubricating oil composition containing a base oil and a viscosity index improver, wherein a kinematic viscosity at 80° C. and a ratio of the kinematic viscosity at 80° C. to an oil film thickness measured at an oil temperature of 80° C. are adjusted to predetermined ranges.

That is, the present invention provides the following [1].

[1] A lubricating oil composition containing a base oil (A) and a viscosity index improver (B) and satisfying the following requirements (I) and (II):

Requirement (I): a kinematic viscosity at 80° C., $V_{80}$ of the lubricating oil composition is 11.5 $mm^2/s$ or less;

Requirement (II): a ratio $[V_{80}/T_{80}]$ of a kinematic viscosity at 80° C., $V_{80}$ ($m^2/s$) to an oil film thickness measured at a sliding speed of 2.0 m/s, a maximum Hertz pressure of 0.8 GPa, and an oil temperature of 80° C., $T_{80}$ (nm) of the lubricating oil composition is less than 0.105 (($m^2/s$)/nm).

Advantageous Effects of Invention

The lubricating oil composition of the present invention is excellent in fuel saving properties and anti-wear properties even when it is used in a temperature environment of around 80° C. which is assumed to fall within a range where an engine is practically used.

DESCRIPTION OF EMBODIMENTS

In this specification, the values of kinetic viscosity and viscosity index are values measured and calculated in conformity with JIS K2283:2000.

In this specification, the values of the weight average molecular weight (Mw) and the number average molecular weight (Mn) of each of the components are each a value in terms of a standard polystyrene conversion as measured by the gel permeation chromatography (GPC), specifically, a value measured according to the method described in the section of Examples.

In this specification, for example, the "alkyl (meth)acrylate" is used as a terminology expressing both an "alkyl acrylate" and a "alkyl methacrylate", and other analogous terms or similar expressions are also the same.

[Lubricating Oil Composition]

The lubricating oil composition of the present invention contains a base oil (A) and a viscosity index improver (B) and satisfies the following requirements (I) and (II).

Requirement (I): a kinematic viscosity at 80° C., $V_{80}$ of the lubricating oil composition is 11.5 $mm^2/s$ or less.

Requirement (II): a ratio $[V_{80}/T_{80}]$ of a kinematic viscosity at 80° C., $V_{80}$ ($m^2/s$) to an oil film thickness measured at a sliding speed of 2.0 m/s, a maximum Hertz pressure of 0.8 GPa, and an oil temperature of 80° C., $T_{80}$ (nm) of the lubricating oil composition is less than 0.105 (($m^2/s$)/nm).

By satisfying the requirement (I), when the lubricating oil composition is used in a temperature environment of around 80° C. which is assumed to fall within a range where an engine is practically used, the lubricating oil composition has a reduced viscosity, thereby contributing to improvement in fuel saving properties based on the lubricating oil composition.

The kinematic viscosity at 80° C., $V_{80}$ of the lubricating oil composition according to the present invention specified by the requirement (I) is 11.5 $mm^2/s$ or less, but is preferably 11.4 $mm^2/s$ or less, more preferably 11.3 $mm^2/s$ or less, and still more preferably 11.2 $mm^2/s$ or less, from the viewpoint of improving fuel saving properties based on the lubricating oil composition.

The kinematic viscosity at 80° C., $V_{80}$ of the lubricating oil composition according to the present invention specified by the requirement (I) is preferably 9.0 $mm^2/s$ or more, more preferably 9.5 $mm^2/s$ or more, and still more preferably 10.0 $mm^2/s$ or more.

Incidentally, the lower viscosity of the lubricating oil composition makes it more difficult to retain an oil film, more easily causing a reduction in anti-wear properties. Further, a decrease in fuel saving properties may be also caused accompanying the reduction in anti-wear properties.

The range of the kinematic viscosity at 80° C., $V_{80}$ specified by the requirement (I) is generally regarded as a range of a low viscosity, and there is a concern that the above-mentioned anti-wear properties and fuel saving properties may be reduced.

With respect to this concern, the lubricating oil composition of the present invention has improved fuel saving properties and anti-wear properties by adjusting the ratio $[V_{80}/T_{80}]$ of the kinematic viscosity at 80° C., $V_{80}$ ($m^2/S$) to the oil film thickness at 80° C., $T_{80}$ (nm) (hereinafter simply referred to as "ratio $[V_{80}/T_{80}]$"), as specified by the above requirement (II).

The ratio $[V_{80}/T_{80}]$ is a parameter indicating the degree of the oil film thickness at 80° C. when assuming that the kinematic viscosity at 80° C., $V_{80}$ is constant within the range specified by the above requirement (I). It can be said that the lubricating oil composition having a more decreased value of the ratio $[V_{80}/T_{80}]$ is one capable of providing a higher oil film retention and more suppressing the deterioration in anti-wear properties.

The ratio $[V_{80}/T_{80}]$ of the lubricating oil composition of the present invention specified by the requirement (II) is less than 0.105 ($m^2/s$)/nm, but is preferably less than 0.104 ($m^2/s$)/nm, more preferably less than 0.103 ($m^2/s$)/nm, and still more preferably less than 0.102 ($m^2/s$)/nm.

Also, the ratio $[V_{80}/T_{80}]$ of the lubricating oil composition of the present invention specified by the requirement (II) is preferably 0.090 ($m^2/s$)/nm or more, more preferably 0.092 ($m^2/s$)/nm or more, and still more preferably 0.095 ($m^2/s$)/nm or more.

In this specification, the oil film thickness $T_{80}$ of the lubricating oil composition is a value measured under conditions of a sliding speed of 2.0 m/s, a maximum Hertz pressure of 0.8 GPa, and an oil temperature of 80° C., and specifically means a value measured according to the method described in the section of Examples.

The kinematic viscosity $V_{80}$ of the lubricating oil composition specified by the requirement (I) can be adjusted by setting the kinematic viscosity of the base oil (A), the molecular weight or the content of the viscosity index improver (B), or the like.

Further, the ratio $[V_{80}/T_{80}]$ of the lubricating oil composition specified by the requirement (II) varies somewhat depending on the type or kinematic viscosity of the base oil (A), the type or content of the additive for a lubricating oil, or the like, but the value tends to vary depending on the difference in properties (structure, molecular weight) of the polymer which is the viscosity index improver (B) contained in the lubricating oil composition, and, in consideration of the description of the viscosity index improver (B) described later, the ratio $[V_{80}/T_{80}]$ can be easily adjusted to the range specified in the requirement (II).

In the lubricating oil composition according to one embodiment of the present invention, the oil film thickness $T_{80}$ measured by the method specified in the requirement (II) is preferably 100 to 111 nm, more preferably 103 to 111 nm, still more preferably 105 to 111 nm, yet still more preferably 107 to 111 nm, and even yet still more preferably 108 to 110 nm.

As used herein, a ratio $[H_{80}/H_{100}]$ of an HTHS viscosity (high-temperature high-shear viscosity) at 80° C., $H_{80}$ to an HTHS viscosity at 100° C., $H_{100}$ of the lubricating oil composition is used as an index based on a consideration of the balance between anti-wear properties and fuel saving properties.

That is, as the value of the HTHS viscosity at 80° C., $H_{80}$ is larger, the retaining property of the oil film formed at around 80° C. is higher, so that the lubricating oil composition is more excellent in anti-wear properties. On the other hand, as the value of the HTHS viscosity at 100° C., $H_{100}$ is smaller, the lubricating oil composition is more excellent in fuel saving properties.

That is, it can be seen that as the value of the ratio $[H_{80}/H_{100}]$ is higher, the lubricating oil composition has more excellent balance in anti-wear properties and fuel saving properties.

In one embodiment of the present invention, the ratio $[H_{80}/H_{100}]$ of the HTHS viscosity (high-temperature high-shear viscosity) at 80° C., $H_{80}$ to the HTHS viscosity at 100° C., $H_{100}$ of the lubricating oil composition is preferably 1.40 or more, more preferably 1.45 or more, still more preferably 1.48 or more, and yet still more preferably 1.49 or more.

In this specification, the HTHS viscosity means a value measured in conformity with ASTM D4741.

The HTHS viscosity at 80° C. of the lubricating oil composition according to one embodiment of the present invention is preferably 4.0 to 7.6 mPa·s, more preferably 4.3 to 7.5 mPa·s, still more preferably 4.7 to 7.4 mPa·s, and yet still more preferably 4.9 to 7.2 mPa·s, from the viewpoint of providing a lubricating oil composition exhibiting an enhanced retention property of the oil film to be formed to exhibit excellent anti-wear properties and thereby exhibiting excellent fuel saving properties, when the composition is used in a temperature environment of around 80° C. which is assumed to fall within a range where an engine is practically used.

The HTHS viscosity at 100° C. of the lubricating oil composition according to one embodiment of the present invention is preferably 3.5 to 5.5 mPa·s, more preferably 3.7 to 5.35 mPa·s, still more preferably 4.0 to 5.2 mPa·s, and yet still more preferably 4.3 to 5.1 mPa·s, from the viewpoint of preparing a lubricating oil composition excellent in lubricating performance and fuel saving properties.

The HTHS viscosity at 150° C. of the lubricating oil composition according to one embodiment of the present invention is preferably 1.7 to 3.3 mPa·s, more preferably 2.0 to 3.2 mPa·s, still more preferably 2.3 to 3.1 mPa·s, and yet still more preferably 2.6 to 2.8 mPa·s, from the viewpoint of preparing a lubricating oil composition excellent in lubricating performance and fuel saving properties under a high temperature range.

The HTHS viscosity at 150° C. described above may also be assumed to be a viscosity under a high-temperature range at the time of high speed operation of an engine. That is, if the HTHS viscosity at 150° C. of the lubricating oil composition falls within the above range, it can be said that the lubricating oil composition is good in various properties such as viscosity under a high-temperature range which is assumed on a high speed operation of an engine.

The kinematic viscosity at 100° C. of the lubricating oil composition according to one embodiment of the present invention is preferably 3.0 to 15.0 $mm^2/s$, more preferably 4.0 to 12.5 $mm^2/s$, still more preferably 5.0 to 11.0 $mm^2/s$, and yet still more preferably 6.0 to 10.0 $mm^2/s$.

The viscosity index of the lubricating oil composition according to one embodiment of the present invention is preferably 140 or more, more preferably 150 or more, still more preferably 160 or more, and yet still more preferably 180 or more.

The lubricating oil composition according to one embodiment of the present invention may further contain an additive for lubricating oil other than the viscosity index improver (B).

However, in the lubricating oil composition according to one embodiment of the present invention, a total content of the components (A) and (B) is preferably 60 to 100% by mass, more preferably 70 to 100% by mass, still more preferably 80 to 100% by mass, and yet still more preferably 85 to 100% by mass on the basis of the whole amount (100% by mass) of the lubricating oil composition.

The details of each component contained in the lubricating oil composition according to one embodiment of the present invention will be described below.

<Base Oil (A)>

The base oil (A) contained in the lubricating oil composition according to one embodiment of the present invention may be a mineral oil or a synthetic oil, and a mixed oil of a mineral oil and a synthetic oil may also be used.

Examples of the mineral oil include a topped crude obtained by atmospheric distillation of a crude oil, such as a paraffinic crude oil, an intermediate crude oil, and a naphthenic crude oil; a distillate oil obtained by vacuum distillation of the topped crude; a mineral oil obtained by subjecting the distillate oil to at least one purification process, such as solvent deasphalting, solvent extraction, hydrocracking, solvent dewaxing, catalytic dewaxing, and hydrorefining; and a mineral oil (GTL) obtained by isomerizing a wax (GTL wax (Gas To Liquids WAX)) produced by Fischer-Tropsch process from natural gas.

These mineral oils may be used alone or in combination of two or more thereof.

Among these, as the mineral oil used in one embodiment of the present invention, a mineral oil obtained by subjecting to at least one purification process, such as solvent deasphalting, solvent extraction, hydrocracking, solvent dewaxing, catalytic dewaxing, and hydrorefining and a mineral oil (GTL) obtained by isomerizing a wax (GTL wax (Gas To Liquids WAX)) produced by Fischer-Tropsch process from natural gas are preferred.

In addition, as the mineral oil, mineral oils classified into Group 2 and Group 3 of the API (American Petroleum Institute) base oil category are preferred, and mineral oils classified into the Group 3 are more preferred.

Examples of the synthetic oil include poly α-olefins, such as polybutene and α-olefin homopolymer or copolymer (e.g., α-olefin homopolymer or copolymer having a carbon number of 8 to 14, such as ethylene-α-olefin copolymer); various esters, such as polyol ester, dibasic acid ester, aromatic ester, and phosphate ester; various ethers such as polyalkylene glycol and polyphenyl ether; polyglycol; alkyl benzene; and alkyl naphthalene.

These synthetic oils may be used alone or in combination of two or more thereof.

The kinematic viscosity at 100° C. of the base oil (A) used in one embodiment of the present invention is preferably 2.0 to 6.0 $mm^2/s$, more preferably 2.0 to 5.5 $mm^2/s$, still more preferably 2.0 to 5.0 $mm^2/s$, and yet still more preferably 2.0 to 4.7 $mm^2/s$.

It is preferable that the kinematic viscosity at 100° C. of the base oil (A) is 2.0 $mm^2/s$ or more, because the evaporation loss is small. On the other hand, it is preferable that the kinematic viscosity at 100° C. of the base oil (A) is 6.0 $mm^2/s$ or less, because power loss due to viscous resistance may be suppressed, so that a fuel consumption improvement effect may be obtained.

The viscosity index of the base oil (A) used in one embodiment of the present invention is preferably 80 or more, more preferably 90 or more, still more preferably 100 or more, yet still more preferably 110 or more, and particularly preferably 120 or more, from the viewpoints of suppressing viscosity change due to temperature change and improving fuel saving properties.

In the lubricating oil composition according to one embodiment of the present invention, when a mixed oil in which two or more kinds of base oils are combined is used, it is preferable that the kinematic viscosity and the viscosity index of the mixed oil are within the ranges described above.

The base oil (A) used in one embodiment of the present invention preferably contains a paraffinic mineral oil from the viewpoints of adjusting the above-described ratio [$H_{80}/H_{100}$] to a predetermined value or more and preparing a lubricating oil composition having anti-wear properties and fuel saving properties which are improved in a balanced manner, and more preferably contains a paraffinic mineral oil (A1) having a viscosity index of 100 or more (more preferably 110 or more, still more preferably 120 or more), and a paraffin content (% $C_P$) of 60 or more (more preferably 65 or more, still more preferably 70 or more, and yet still more preferably 75 or more).

In this specification, the paraffin content (% $C_P$) of the base oil (A) means the ratio (percentage) of paraffin content measured in conformity with ASTM D-3238 ring analysis (n-d-M method).

The content of the paraffinic mineral oil (A1) in the base oil (A) according to one embodiment of the present invention is preferably 60 to 100% by mass, more preferably 70 to 100% by mass, still more preferably 80 to 100% by mass, and yet still more preferably 90 to 100% by mass on the basis of the whole amount (100% by mass) of the base oil (A).

In the lubricating oil composition according to one embodiment of the present invention, the content of the base oil (A) is preferably 55% by mass or more, more preferably 60% by mass or more, still more preferably 65% by mass or more, and yet still more preferably 70% by mass or more, and it is preferably 99% by mass or less and more preferably 95% by mass or less, on the basis of the whole amount (100% by mass) of the lubricating oil composition.

<Viscosity Index Improver (B)>

The lubricating oil composition of the present invention contains a viscosity index improver (B) and is prepared so as to satisfy the requirements (I) and (II) described above.

The viscosity of the requirement (I) to be satisfied by the lubricating oil composition of the present invention is mainly dependent on the viscosity characteristics of the base oil (A), but adjustment to satisfy the requirement (I) may also be performed by an index such as the molecular weight and the content of the viscosity index improver (B).

In addition, the parameter specified in the requirement (II) to be satisfied by the lubricating oil composition of the present invention is somewhat influenced by the difference in types and contents of the base oil (A) and additives for lubricating oil other than the viscosity index improver (B), but the dependency on the additive for lubricating oil is small as compared to the influence due to the difference in the structure of the viscosity index improver (B).

In other words, the parameter specified in the requirement (II) is highly dependent on the structure of the polymer such as type and molecular weight of the constituent unit of the polymer used as the viscosity index improver (B). Further, the parameter specified in the requirement (II) varies considerably depending on the content of the viscosity index improver (B).

In the lubricating oil composition according to one embodiment of the present invention, the content of the viscosity index improver (B) is preferably 0.1 to 5.0% by mass, more preferably 0.3 to 4.0% by mass, still more preferably 0.5 to 3.5% by mass, and yet still more preferably 1.0 to 3.0% by mass on the basis of the whole amount (100% by mass) of the lubricating oil composition, from the viewpoint of preparing the lubricating oil composition satisfying the above-mentioned requirements (I) and (II), particularly the requirement (I).

In view of handling properties and solubility in the base oil (A), the viscosity index improver (B) is often commercially available in the form of a solution in which a resin component constituting a viscosity index improver is dissolved in a diluent oil such as mineral oil or synthetic oil.

In this specification, the "content of the viscosity index improver (B)" is the content in terms of a resin component constituting the viscosity index improver, and the weight of the diluent oil is excluded.

In addition, the term "resin component" as used herein means a polymer having a weight average molecular weight (Mw) of 1000 or more and having a constant repeating unit.

In the lubricating oil composition according to one embodiment of the present invention, the weight average molecular weight (Mw) of the viscosity index improver (B) is preferably 200,000 to 800,000, more preferably 250,000 to 750,000, still more preferably 300,000 to 700,000, and yet still more preferably 350,000 to 650,000 from the viewpoint of preparing the lubricating oil composition satisfying the above requirements (I) and (H).

Specific examples of the viscosity index improver (B) include any one capable of adjusting the lubricating oil composition to prepare the lubricating oil composition satisfying the requirements (I) and (II), and for example, a polymethacrylate, a dispersion type polymethacrylate, an olefin-based copolymer (for example, an ethylene-propylene copolymer), a dispersion type olefin-based copolymer, or a styrene-based copolymer (for example, a styrene-diene copolymer and a styrene-isoprene copolymer) may be used.

However, in particular, from the viewpoint of preparing the lubricating oil composition satisfying the requirement (II), it is preferable that the viscosity index improver (B) used in one embodiment of the present invention contains a comb-shaped polymer (B1).

The content of the comb-shaped polymer (B1) in the viscosity index improver (B) used in one embodiment of the present invention is preferably 70 to 100% by mass, more preferably 80 to 100% by mass, still more preferably 90 to 100% by mass, and yet still more preferably 95 to 100% by mass on the basis of the whole amount (100% by mass, in terms of resin component) of the resin component of the viscosity index improver (B), from the viewpoint of adjusting the lubricating oil composition to prepare that satisfying the requirements (I) and (II), particularly the requirement (II).

The comb-shaped polymer (B1) which is suitable as the viscosity index improver (B) will be described below.

<Comb-Shaped Polymer (B1)>

The "comb-shaped polymer" used in one embodiment of the present invention refers to a polymer having a structure having a large number of trigeminal branch points from which a high-molecular weight side chain comes out in a main chain thereof.

In one embodiment of the present invention, by using the comb-shaped polymer (B1) as the viscosity index improver (B), the ratio $[V_{80}/T_{80}]$ specified in the requirement (II) of the obtained lubricating oil composition can be relatively easily adjusted to a low value.

That is, by using the comb-shaped polymer (B1), it is easy to prepare a lubricating oil composition satisfying the requirement (II), and as a result, the lubricating oil composition can easily have the HTHS viscosity at 80° C., which is mainly assumed to fall within a range where an engine is practically used, adjusted to a suitable range and can become a composition capable of easily retaining a thickness of an oil film formed therefrom to a sufficient degree at around 80° C.

A weight average molecular weight (Mw) of the comb-shaped polymer (B1) is preferably 200,000 to 800,000, more preferably 250,000 to 750,000, still more preferably 300,000 to 700,000, and yet still more preferably 350,000 to 650,000, from the viewpoint of preparing the lubricating oil composition satisfying the requirements (I) and (II), particularly the requirement (II).

A molecular weight distribution (Mw/Mn) of the comb-shaped polymer (B1) (Mw represents a weight average molecular weight of the comb-shaped polymer (B1), and Mn represents a number average molecular weight of the comb-shaped polymer (B1)) is preferably 7.00 or less, more preferably 6.00 or less, still more preferably 5.00 or less, and yet still more preferably 3.00 or less, from the viewpoint of preparing the lubricating oil composition satisfying the requirements (I) and (II), particularly the requirement (II).

As the molecular weight distribution (Mw/Mn) of the comb-shaped polymer (B1) is smaller, the fuel consumption performance based on the lubricating oil composition containing the comb-shaped polymer (B1) together with the base oil (A) tends to be more improved.

Although the molecular weight distribution of the comb-shaped polymer (B1) is not particularly limited with respect to its lower limit value, it is typically 1.01 or more, preferably 1.05 or more, and more preferably 1.10 or more.

SSI (shear stability index) of the comb-shaped polymer (B1) is preferably 12.0 or less, more preferably 10.0 or less, still more preferably 5.0 or less, yet still more preferably 3.0 or less, and particularly preferably less than 1.0, from the viewpoint of preparing the lubricating oil composition satisfying the requirement Although the SSI of the comb-shaped polymer (B1) is not particularly limited with respect to its lower limit value, it is typically 0.1 or more.

In this specification, the SSI (shear stability index) of the comb-shaped polymer (B1) expresses a percentage of a lowering of the viscosity by shearing originated from the resin component in the comb-shaped polymer (B1) and is a value as measured in conformity with ASTM D6278. More specifically, the SSI is a value as calculated according to the following calculation formula (1).

$$SSI = \frac{Kv_0 - Kv_1}{Kv_0 - Kv_{oil}} \times 100 \quad (1)$$

In the formula (1), $Kv_0$ represents a value of kinematic viscosity at 100° C. of a sample oil obtained by diluting a viscosity index improver containing a resin component with a mineral oil; and $Kv_1$ represents a value of kinematic viscosity at 100° C. of the sample obtained after passing the sample oil obtained by diluting the viscosity index improver containing the resin component with a mineral oil through a high-shear Bosch diesel injector for 30 cycles according to the procedures of ASTM D6278. In addition, $Kv_{oil}$ represents a value of kinematic viscosity at 100° C. of the mineral oil used in diluting the viscosity index improver.

The value of SSI of the comb-shaped polymer (B1) varies with the structure of the comb-shaped polymer (B1). Specifically, there are the following tendencies, and by considering these matters, the value of SSI of the comb-shaped polymer (B1) can be easily regulated. The following matters are described as representative examples, and it is also possible to make regulations considering matters different from the following matters.

The comb-shaped polymer in which the side chain of the comb-shaped polymer is composed of the macromonomer (x1) and the content of the constituent unit (X1) derived from the macromonomer (x1) is 0.5 mol % or more on the basis of the whole amount (100 mol %) of the constituent unit tends to have a low SSI value.

As the molecular weight of the macromonomer (x1) constituting the side chain of the comb-shaped polymer is higher, the comb-shaped polymer tends to have a lower SSI value.

<Constituent Unit of Comb-Shaped Polymer (B1)>

The constituent unit of the comb-shaped polymer (B1) used in one embodiment of the present invention will be described below.

In one embodiment of the present invention, "the use of comb-shaped polymer (B1) does not necessarily result in a lubricating oil composition satisfying the requirement (II)".

In general, the comb-shaped polymer is known to have a very large number of structures.

In the present invention, a specific comb-shaped polymer (B1) is selected from the comb-shaped polymers present in such a large number considering the preferred embodiments described above appropriately to prepare a lubricating oil composition satisfying the requirement (II).

In the following description, the matters relating to preferred embodiments of the respective constituent units are indicated as means for adjusting the lubricating oil composition satisfying the requirement (II) unless otherwise specified.

As the comb-shaped polymer (B1), a polymer having at least the constituent unit (X1) derived from the macromonomer (x1) is preferred. This constituent unit (X1) corresponds to the aforementioned "high-molecular weight side chain".

In the present invention, the aforementioned "macromonomer" means a high-molecular weight monomer having a polymerizable functional group and is preferably a high-molecular weight monomer having a polymerizable functional group in an end thereof.

A comb-shaped polymer having a relatively long main chain with respect to a side chain has low shear stability, and therefore, when such a comb-shaped polymer is used, the value of the ratio $[V_{80}/T_{80}]$ tends to be large.

That is, as the content of the constituent unit (X1) derived from the macromonomer (x1) of the comb-shaped polymer (B1) is larger and the molecular weight of the macromonomer (x1) is larger, the ratio $[V_{80}/T_{80}]$ is easily adjusted to a smaller value.

In the comb-shaped polymer (B1) used in one embodiment of the present invention, from the above viewpoint, the content of the constituent unit (X1) is preferably 0.5 to 20 mol %, more preferably 0.7 to 10 mol %, still more preferably 0.9 to 5 mol %, and yet still more preferably 0.9 to 2 mol % on the basis of the whole amount (100 mol %) of the constituent unit of the comb-shaped polymer (B1).

In this specification, the content of each constituent unit in the comb-shaped polymer (B1) means a value calculated by analyzing the $^{13}$C-NMR quantitative spectrum.

From the above viewpoint, a number average molecular weight (Mn) of the macromonomer (x1) is preferably 300 or more, more preferably 500 or more, still more preferably 1,000 or more, yet still more preferably 2,000 or more, and even yet still more preferably 4,000 or more, and it is preferably 100,000 or less, more preferably 50,000 or less, still more preferably 20,000 or less, and yet still more preferably 10,000 or less.

Examples of the polymerizable functional group which the macromonomer (x1) has include an acryloyl group ($CH_2$═CH—COO—), a methacryloyl group ($CH_2$═$CCH_3$—COO—), an ethenyl group ($CH_2$═CH—), a vinyl ether group ($CH_2$═CH—O—), an allyl group ($CH_2$═CH—$CH_2$—), an allyl ether group ($CH_2$═CH—$CH_2$—O—), a group represented by $CH_2$═CH—CONH—, and a group represented by $CH_2$═$CCH_3$—CONH—.

The macromonomer (x1) may also have at least one selected from repeating units represented by the following general formulae (i) to (iii) in addition to the aforementioned polymerizable functional groups.

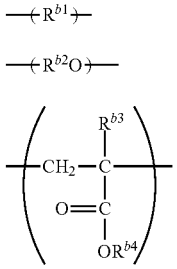

(i)

(ii)

(iii)

In the general formula (i), $R^{b1}$ represents a linear or branched alkylene group having a carbon number of 1 to 10, and specifically, examples thereof include a methylene group, an ethylene group, a 1,2-propylene group, a 1,3-propylene group, a 1,2-butylene group, a 1,3-butylene group, a 1,4-butylene group, a pentylene group, a hexylene group, a heptylene group, an octylene group, a nonylene group, a decylene group, and a 2-ethylhexylene group.

In the general formula (ii), $R^{b2}$ represents a linear or branched alkylene group having a carbon number of 2 to 4, and specifically, examples thereof include an ethylene group, a 1,2-propylene group, a 1,3-propylene group, a 1,2-butylene group, a 1,3-butylene group, and a 1,4-butylene group.

In the general formula (iii), $R^{b3}$ represents a hydrogen atom or a methyl group.

$R^{b4}$ represents a linear or branched alkyl group having a carbon number of 1 to 10, and specifically, examples thereof include a methyl group, an ethyl group, a n-propyl group, a n-butyl group, a n-pentyl group, a n-hexyl group, a n-heptyl group, a n-octyl group, a n-nonyl group, a n-decyl group, an isopropyl group, an isobutyl group, a sec-butyl group, a tert-butyl group, an isopentyl group, a tert-pentyl group, an isohexyl group, a tert-hexyl group, an isoheptyl group, a tert-heptyl group, a 2-ethylhexyl group, an isooctyl group, an isononyl group, and an isodecyl group.

In the case where the macromonomer (x1) has a plurality of repeating may be each the same as or different from each other.

In one embodiment of the present invention, the macromonomer (x1) is preferably a polymer having a repeating unit represented by the general formula (i), and more preferably a polymer having a repeating unit (X1-1) in which $R^{b1}$ in the general formula (i) is a 1,2-butylene group and/or a 1,4-butylene group.

The content of the repeating unit (X1-1) is preferably 1 to 100 mol %, more preferably 20 to 95 mol %, still more preferably 40 to 90 mol %, and yet still more preferably 50 to 80 mol % on the basis of the whole amount (100 mol %) of the constituent unit of the macromonomer (x1).

In the case where the macromonomer (x1) is a copolymer having two or more repeating units selected from the general formulae (i) to (iii), the mode of the copolymer may be a block copolymer or may be a random copolymer.

The comb-shaped polymer (B1) that is used in one embodiment of the present invention may be a homopolymer composed of only the constituent unit (X1) derived from one kind of the macromonomer (x1) or may be a copolymer containing the constituent unit (X1) derived from two or more kinds of the macromonomer (x1).

In addition, the comb-shaped polymer (B1) that is used in one embodiment of the present invention may also be a copolymer containing the constituent unit derived from the macromonomer (x1) as well as a constituent unit (X2) derived from other monomer (x2) than the macromonomer (x1).

As a specific structure of such a comb-shaped polymer, a copolymer having a side chain containing the constituent unit (X1) derived from the macromonomer (x1) relative to the main chain including the constituent unit (X2) derived from the monomer (x2) is preferred.

Examples of the monomer (x2) include a monomer (x2-a) represented by the following general formula (a1), an alkyl (meth)acrylate (x2-b), a nitrogen atom-containing vinyl monomer (x2-c), a hydroxy group-containing vinyl monomer (x2-d), a phosphorus atom-containing monomer (x2-e), an aliphatic hydrocarbon-based vinyl monomer (x2-f), an alicyclic hydrocarbon-based vinyl monomer (x2-g), a vinyl ester (x2-h), a vinyl ether (x2-i), a vinyl ketone (x2-j), an epoxy group-containing vinyl monomer (x2-k), a halogen element-containing vinyl monomer (x2-l), an ester of unsaturated polycarboxylic acid (x2-m), a (di)alkyl fumarate (x2-n), a (di)alkyl maleate (x2-o), and an aromatic hydrocarbon-based vinyl monomer (x2-p).

Further, as the monomer (x2), it is preferable to include at least one kind selected from a monomer represented by the following general formula (a1), an alkyl (meth)acrylate (x2-b), and a hydroxy group-containing vinyl monomer (x2-d), and it is more preferable to include at least a hydroxy group-containing vinyl monomer (x2-d).

The content of the constituent unit derived from the hydroxy group-containing vinyl monomer (x2-d) is preferably 0.1 to 30 mol %, more preferably 0.5 to 20 mol %, still more preferably 1 to 15 mol %, and yet still more preferably 3 to 10 mol % on the basis of the whole amount (100 mol %) of the constituent unit of the comb-shaped polymer (B1).

(Monomer (x2-a) Represented by the Following General Formula (a1))

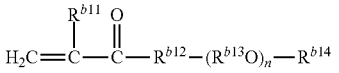

(a1)

In the general formula (a1), $R^{b11}$ represents a hydrogen atom or a methyl group.

$R^{b12}$ represents a single bond, a linear or branched alkylene group having a carbon number of 1 to 10, —O—, or —NH—.

$R^{b13}$ represents a linear or branched alkylene group having a carbon number of 2 to 4. In addition, n represents an integer of 1 or more (preferably an integer of 1 to 20, and more preferably an integer of 1 to 5). In the case where n is an integer of 2 or more, plural $R^{b13}$'s may be the same as or different from each other, and furthermore, the $(R^{b13}O)_n$ moiety may be either a random bond or a block bond.

$R^{b14}$ represents a linear or branched alkyl group having a carbon number of 1 to 60 (preferably 10 to 50, and more preferably 20 to 40).

Specific groups of the aforementioned "linear or branched alkylene group having a carbon number of 1 to 10", "linear or branched alkylene group having a carbon number of 2 to 4", and "linear or branched alkyl group having a carbon number of 1 to 60" include the same groups as those exemplified in the descriptions regarding the aforementioned general formulae (i) to (Alkyl (meth)acrylate (x2-b))

Examples of the alkyl (meth)acrylate (x2-b) include methyl (meth)acrylate, ethyl (meth)acrylate, n-propyl (meth) acrylate, isopropyl (meth) acrylate, n-butyl (meth) acrylate, tert-butyl (meth)acrylate, pentyl (meth) acrylate, hexyl (meth) acrylate, 2-ethylhexyl (meth) acrylate, heptyl (meth) acrylate, 2-tert-butylheptyl (meth)acrylate, octyl (meth) acrylate, and 3-isopropylheptyl (meth)acrylate.

The carbon number of the alkyl group which the alkyl (meth)acrylate (x2-b) has is preferably 4 to 30, more preferably 4 to 24, and still more preferably 4 to 18.

The alkyl group may be a linear alkyl group or a branched alkyl group.

In one embodiment of the present invention, the monomer (x2) contains, as alkyl (meth)acrylate (x2-b), both butyl (meth)acrylate and alkyl (meth)acrylate having an alkyl group having a carbon number of 12 to 20, whereby the ratio $[V_{80}/T_{80}]$ can easily be adjusted to a small value.

The content ratio $[(\alpha)/(\beta)]$ of the constituent unit ($\alpha$) derived from the butyl (meth)acrylate to the constituent unit ($\beta$) derived from the alkyl (meth)acrylate having an alkyl group having a carbon number of 12 to 20 is preferably 7.00 or more, more preferably 8.50 or more, and still more preferably 10.00 or more, and it is preferably 20 or less, in terms of molar ratio.

The content of the constituent unit ($\alpha$) derived from the butyl (meth)acrylate is preferably 40 to 95 mol %, more preferably 50 to 90 mol %, and still more preferably 60 to 85 mol % on the basis of the whole amount (100 mol %) of the constituent unit of the comb-shaped polymer (B1).

The content of the constituent unit ($\beta$) derived from the alkyl (meth)acrylate having an alkyl group having a carbon number of 12 to 20 is preferably 1 to 30 mol %, more preferably 3 to 25 mol %, and still more preferably 5 to 20 mol % on the basis of the whole amount (100 mol %) of the constituent unit of the comb-shaped polymer (B1).

(Nitrogen Atom-Containing Vinyl Monomer (x2-c))

Examples of the nitrogen atom-containing vinyl monomer (x2-c) include an amide group-containing vinyl monomer (x2-c1), a nitro group-containing monomer (x2-c2), a primary amino group-containing vinyl monomer (x2-c3), a secondary amino group-containing vinyl monomer (x2-c4), a tertiary amino group-containing vinyl monomer (x2-c5), and a nitrile group-containing vinyl monomer (x2-c6).

Examples of the amide group-containing vinyl monomer (x2-c1) include (meth) acrylamide; monoalkylamino (meth) acrylamides, such as N-methyl (meth)acrylamide, N-ethyl (meth)acrylamide, N-isopropyl (meth)acrylamide, and N-n- or isobutyl (meth)acrylamide; monoalkylaminoalkyl (meth) acrylamides, such as N-methylaminoethyl (meth)acrylamide, N-ethylaminoethyl (meth)acrylamide, N-isopropylamino-n-butyl (meth)acrylamide, and N-n- or isobutylamino-n-butyl (meth)acrylamide; di alkylamino (meth)acrylamides, such as N,N-dimethyl (meth)acrylamide, N,N-diethyl (meth)acrylamide, N,N-diisopropyl (meth) acrylamide, and N,N-di-n-butyl (meth)acrylamide; dialkylamino alkyl (meth)acrylamides, such as N,N-dimethylaminoethyl (meth)acrylamide, N,N-oliethylaminoethyl (meth)acrylamide, N,N-olimethylaminopropyl (meth) acrylamide, and N,N-di-n-butylaminobutyl (meth)acrylamide; and N-vinylcarboxylic acid amides, such as N-vinylformamide, N-vinylacetamide, N-vinyl-n- or isopropionylamide, and N-vinylhydroxyacetamide.

Examples of the nitro group-containing monomer (x2-c2) include nitroethylene and 3-nitro-1-propene.

Examples of the primary amino group-containing vinyl monomer (x2-c3) include alkenylamines having an alkenyl group having a carbon number of 3 to 6, such as (meth) allylamine and crotylamine; and aminoalkyl (meth)acrylates having an alkyl group having a carbon number of 2 to 6, such as aminoethyl (meth)acrylate.

Examples of the secondary amino group-containing vinyl monomer (x2-c4) include mono alkylaminoalkyl (meth) acrylates, such as tert-butylaminoethyl (meth)acrylate and methylaminoethyl (meth) acrylate; and dialkenylamines having a carbon number of 6 to 12, such as di(meth) allylamine.

Examples of the tertiary amino group-containing vinyl monomer (x2-c5) include dialkylaminoalkyl (meth)acrylates, such as dimethylaminoethyl (meth)acrylate and diethylaminoethyl (meth) acrylate; alicyclic (meth)acrylates having a nitrogen atom, such as morpholinoethyl (meth) acrylate; and hydrochlorides, sulfates, phosphates, or lower alkyl (carbon number: 1 to 8) monocarboxylic acid (e.g., acetic acid and propionic acid) salts thereof.

Examples of the nitrile group-containing vinyl monomer (x2-c6) include (meth)acrylonitrile.

(Hydroxy Group-Containing Vinyl Monomer (x2-d))

Examples of the hydroxy group-containing vinyl monomer (x2-d) include a hydroxy group-containing vinyl monomer (x2-d1) and a polyoxyalkylene chain-containing vinyl monomer (x2-d2).

Examples of the hydroxy group-containing vinyl monomer (x2-d1) include hydroxyalkyl (meth)acrylates having an alkyl group having a carbon number of 2 to 6, such as 2-hydroxyethyl (meth)acrylate and 2- or 3-hydroxypropyl (meth) acrylate; mono- or di-hydroxyalkyl-substituted (meth)acrylamides having an alkyl group having a carbon number of 1 to 4, such as N,N-dihydroxymethyl (meth) acrylamide, N,N-dihydroxypropyl (meth) acrylamide, and N,N-di-2-hydroxybutyl (meth) acrylamide; vinyl alcohol; alkenols having a carbon number of 3 to 12, such as (meth)allyl alcohol, crotyl alcohol, isocrotyl alcohol, 1-octenol, and 1-undecenol; alkene monools or alkene olio's each having a carbon number of 4 to 12, such as 1-buten-3-ol, 2-buten-1-ol, and 2-butene-1,4-diol; hydroxyalkyl alkenyl ethers having an alkyl group having a carbon number of 1 to 6 and an alkenyl group having a carbon number of 3 to 10, such as 2-hydroxyethyl propenyl ether; and compounds in which an unsaturated group is introduced into a polyhydric alcohol such as glycerin, pentaerythritol, sorbitol, sorbitan, diglycerin, glyceric acid, a sugar, and sucrose.

Among these, a hydroxy group-containing vinyl monomer having two or more hydroxy groups is preferred, and a compound in which an unsaturated group is introduced into a polyhydric alcohol is more preferred.

Examples of the polyoxyalkylene chain-containing vinyl monomer (x2-d2) include a polyoxyalkylene glycol (carbon number of the alkylene group: 2 to 4, degree of polymerization: 2 to 50), a polyoxyalkylene polyol (polyoxyalkylene ether of the aforementioned polyhydric alcohol (carbon number of the alkylene group: 2 to 4, degree of polymerization: 2 to 100)), a mono(meth)acrylate of an alkyl ether (carbon number: 1 to 4) of a polyoxyalkylene glycol or polyoxyalkylene polyol [e.g., polyethylene glycol (Mn: 100 to 300) mono(meth)acrylate, polypropylene glycol (Mn: 130 to 500) mono(meth)acrylate, methoxypolyethylene glycol (Mn: 110 to 310) (meth)acrylate, lauryl alcohol ethylene oxide adduct (2 to 30 mols) (meth)acrylate, and mono(meth) acrylic acid polyoxyethylene (Mn: 150 to 230) sorbitan, etc.].

(Phosphorus Atom-Containing Monomer (x2-e))

Examples of the phosphorus atom-containing monomer (x2-e) include a phosphate ester group-containing monomer (x2-e1) and a phosphono group-containing monomer (x2-e2).

Examples of the phosphate ester group-containing monomer (x2-e1) include (meth)acryloyloxyalkyl phosphates having an alkyl group having a carbon number of 2 to 4, such as (meth)acryloyloxyethyl phosphate and (meth)acryloyloxyisopropyl phosphate; and alkenyl phosphates having an alkenyl group having a carbon number of 2 to 12, such as vinyl phosphate, allyl phosphate, propenyl phosphate, isopropenyl phosphate, butenyl phosphate, pentenyl phosphate, octenyl phosphate, decenyl phosphate, and dodecenyl phosphate.

Examples of the phosphono group-containing monomer (x2-e2) include (meth)acryloyloxyalkyl phosphonates having an alkyl group having a carbon number of 2 to 4, such as (meth)acryloyloxyethyl phosphonate; and alkenyl phosphonates having an alkenyl group having a carbon number of 2 to 12, such as vinyl phosphonate, allyl phosphonate, and octenyl phosphonate.

(Aliphatic Hydrocarbon-Based Vinyl Monomer (x2-0)

Examples of the aliphatic hydrocarbon-based vinyl monomer (x2-f) include alkenes having a carbon number of 2 to 20, such as ethylene, propylene, butene, isobutylene, pentene, heptene, diisobutylene, octene, dodecene, and octadecene; and alkadienes having a carbon number of 4 to 12, such as butadiene, isoprene, 1,4-pentadiene, 1,6-heptadiene, and 1,7-octadiene.

The carbon number of the aliphatic hydrocarbon-based vinyl monomer (x2-f) is preferably 2 to 30, more preferably 2 to 20, and still more preferably 2 to 12.

(Alicyclic Hydrocarbon-Based Vinyl Monomer (x2-g))

Examples of the alicyclic hydrocarbon-based vinyl monomer (x2-g) include cyclohexene, (di)cyclopentadiene, pinene, limonene, vinylcyclohexene, and ethylidene bicycloheptene.

The carbon number of the alicyclic hydrocarbon-based vinyl monomer (x2-g) is preferably 3 to 30, more preferably 3 to 20, and still more preferably 3 to 12.

(Vinyl Ester (x2-h))

Examples of the vinyl ester (x2-h) include vinyl esters of a saturated fatty acid having a carbon number of 2 to 12, such as vinyl acetate, vinyl propionate, vinyl butyrate, and vinyl octanoate.

(Vinyl Ether (x2-i))

Examples of the vinyl ether (x2-i) include alkyl vinyl ethers having a carbon number of 1 to 12, such as methyl vinyl ether, ethyl vinyl ether, propyl vinyl ether, butyl vinyl ether, and 2-ethylhexyl vinyl ether; and alkoxyalkyl vinyl ethers having a carbon number of 1 to 12, such as vinyl-2-methoxyethyl ether and vinyl-2-butoxyethyl ether.

(Vinyl Ketone (x2-j))

Examples of the vinyl ketone (x2-j) include alkyl vinyl ketones having a carbon number of 1 to 8, such as methyl vinyl ketone and ethyl vinyl ketone.

(Epoxy Group-Containing Vinyl Monomer (x2-k))

Examples of the epoxy group-containing vinyl monomer (x2-k) include glycidyl (meth)acrylate and glycidyl (meth) allyl ether.

(Halogen Element-Containing Vinyl Monomer (x2-1))

Examples of the halogen element-containing vinyl monomer (x2-1) include vinyl chloride, vinyl bromide, vinylidene chloride, and (meth)allyl chloride.

(Ester of Unsaturated Polycarboxylic Acid (x2-m))

Examples of the ester of unsaturated polycarboxylic acid (x2-m) include an alkyl ester of an unsaturated polycarboxylic acid, a cycloalkyl ester of an unsaturated polycarboxylic acid, and an aralkyl ester of an unsaturated polycarboxylic acid; and examples of the unsaturated carboxylic acid include maleic acid, fumaric acid, and itaconic acid.

((Di)alkyl fumarate (x2-n))

Examples of the (di)alkyl fumarate (x2-n) include monomethyl fumarate, dimethyl fumarate, monoethyl fumarate, diethyl fumarate, methylethyl fumarate, monobutyl fumarate, dibutyl fumarate, dipentyl fumarate, and dihexyl fumarate.

((Di)Alkyl Maleate (x2-o))

Examples of the (di)alkyl maleate (x2-o) include monomethyl maleate, dimethyl maleate, monoethyl maleate, diethyl maleate, methylethyl maleate, monobutyl maleate, and dibutyl maleate.

(Aromatic Hydrocarbon-Based Vinyl Monomer (x2-p))

Examples of the aromatic hydrocarbon-based vinyl monomer (x2-p) include styrene, α-methylstyrene, α-ethylstyrene, vinyltoluene, 2,4-dimethylstyrene, 4-ethylstyrene, 4-isopropylstyrene, 4-butylstyrene, 4-phenylstyrene, 4-cyclohexylstyrene, 4-benzylstyrene, p-methylstyrene, monochlorostyrene, dichlorostyrene, tribromostyrene, tetrabromostyrene, 4-crotylbenzene, indene, and 2-vinylnaphthalene.

The carbon number of the aromatic hydrocarbon-based vinyl monomer (x2-p) is preferably 8 to 30, more preferably 8 to 20, and still more preferably 8 to 18.

The monomer (x2) is preferably a monomer other than the phosphorus atom-containing monomer (x2-e) and the aromatic hydrocarbon-based vinyl monomer (x2-p).

That is, it is preferable that the content of the constituent unit derived from the phosphorus atom-containing monomer (x2-e) and the content of the constituent unit derived from the aromatic hydrocarbon-based vinyl monomer (x2-p) are as small as possible.

The content of the constituent unit derived from the phosphorus atom-containing monomer (x2-e) is preferably less than 0.01 mol %, more preferably less than 0.001 mol %, and still more preferably 0 mol % on the basis of the whole amount (100 mol %) of the constituent unit of the comb-shaped polymer (B1).

The content of the constituent unit derived from the aromatic hydrocarbon-based vinyl monomer (x2-p) is preferably less than 0.01 mol %, more preferably less than 0.001 mol %, and still more preferably 0 mol % on the basis of the whole amount (100 mol %) of the constituent unit of the comb-shaped polymer (B1).

<Additive for Lubricating Oil>

The lubricating oil composition according to one embodiment of the present invention may further contain an additive for a lubricating oil other than the component (B) (hereinafter also referred to simply as "additive for lubricating oil"), as required, within a range where the effects of the present invention are not impaired.

Examples of such an additive for lubricating oil include a pour-point depressant, a metal-based detergent, a dispersant, an anti-wear agent, an extreme pressure agent, an antioxidant, an anti-foaming agent, a rust inhibitor, and a metal deactivator.

The respective additives for lubricating oil may be used either alone or in combination of two or more thereof.

A commercially available additive package containing a plurality of additives and meeting API/ILSAC SN/GF-5 standards may be used as an additive for lubricating oil.

A compound having plural functions as the additive (for example, a compound having functions as an anti-wear agent and an extreme pressure agent) may also be used.

Although the content of each of such additives for lubricating oil can be appropriately adjusted within a range where the effects of the present invention are not impaired, it is typically 0.001 to 15% by mass, preferably 0.005 to 10% by mass, and more preferably 0.01 to 8% by mass on the basis of the whole amount (100% by mass) of the lubricating oil composition.

[Production Method of Lubricating Oil Composition]

The method for producing the lubricating oil composition of the present invention is not particularly limited, and examples thereof include a method including a step of blending the viscosity index improver (B) in the base oil.

In addition, when the viscosity index improver (B) is blended, the additive for lubricating oil may be blended as needed.

In the above process, matters relating to the base oil (A) and the viscosity index improver (B) are as described above, and suitable components and the content of each component are also as described above.

The viscosity index improver (B) may be blended in the form of a solution in which a resin component of a viscosity index improver is dissolved in a diluted oil. The concentration of the resin component in the solution is usually 10 to 50% by mass.

After each component is blended, it is preferable to disperse the component uniformly by stirring according to a known method.

[Application of Lubricating Oil Composition]

The lubricating oil composition of the present invention is excellent in fuel saving properties and anti-wear properties even when it is used in a temperature environment of around 80° C. which is assumed to fall within a range where an engine is practically used.

Therefore, the lubricating oil composition of the present invention is preferably used as an engine oil.

Examples of an engine which the lubricating oil composition of the present invention is used suitably for include an engine for a vehicle such as an automobile, a train, and an aircraft, and an engine for an automobile is preferred, and an engine for an automobile equipped with a hybrid mechanism or an idling stop mechanism is more preferred.

That is, the present invention may also provide a method of using a lubricating oil as shown in the following [1].

[1] A method of using a lubricating oil composition, including using the lubricating oil composition of the present invention described above as an engine oil for an automobile engine equipped with at least one of a hybrid mechanism and an idling stop mechanism.

Although the lubricating oil composition according to one embodiment of the present invention is suitable for use as a lubricating oil composition for internal combustion engines (engine oil for internal combustion engines) used for vehicles such as an automobile, a train, and an aircraft, it is also applicable to other applications.

EXAMPLES

The present invention is hereunder described in more detail by reference to Examples, but it should be construed that the present invention is by no means limited by the following Examples. The measurement methods and evaluation methods of various physical properties are as follows.

(1) Kinetic Viscosities at 80° C. and 100° C.

The measurement was performed in conformity with JIS K2283:2000.

(2) Viscosity Index

The calculation was performed in conformity with JIS K2283:2000.

(3) Paraffin Content (% $C_P$)

The measurement was performed in conformity with ASTM D-3238 ring analysis (n-d-M method).

(4) Weight Average Molecular Weight (Mw), Number Average Molecular Weight (Mn)

The measurement was performed by using a gel permeation chromatography device ("1260 Type HPLC", manufactured by Agilent Technologies, Inc.) under the following conditions, and the values measured in terms of a standard polystyrene conversion were adopted.

(Measurement Conditions)

Column: Two "Shodex LF404" columns connected in series

Column temperature: 35° C.

Developing solvent: Chloroform

Flow rate: 0.3 mL/min (5) SSI (Shear Stability Index)

To a viscosity index improver to be measured, a mineral oil that is a diluent oil was added to prepare a sample oil, and the SSI was measured using the sample oil and the mineral oil in conformity with ASTM D6278.

Specifically, with respect to the viscosity index improver to be measured, each of $Kv_0$, $Kv_1$, and $Kv_{oil}$ values in the aforementioned calculation formula (1) was measured, and the SSI was calculated according to the calculation formula (1).

(6) Oil Film Thickness at 80° C., $T_{80}$

With respect to the lubricating oil composition prepared, an oil film thickness at 80° C., $T_{80}$ (unit: nm) was measured under the conditions of a sliding speed of 2.0 m/s, a maximum Hertz pressure of 0.8 GPa, and an oil temperature of 80° C., using a product name "EHD 2 oil film thickness measuring instrument" (manufactured by PCS Instrument) as a measuring apparatus.

(7) HTHS Viscosities at 80° C., 100° C., and 150° C. (High-Temperature High-Shear Viscosities)

With respect to the lubricating oil composition prepared, viscosities after shearing at a shear rate of $10^6$/s under temperature conditions at 80° C., 100° C., and 150° C., respectively, were measured in conformity with ASTM D4741.

The details of the viscosity index improver used in the following Examples and Comparative Examples are shown in Table 1.

The content of the constituent unit of the viscosity index improvers (1) to (5) shown in Table 1 is a value calculated by analyzing the $^{13}$C-NMR quantitative spectrum obtained by using a nuclear magnetic resonance apparatus (NMR) (product name "400 MHz Year Hold Magnet" manufactured by JEOL Ltd.).

TABLE 1

| | | Viscosity Index Improver | | | | |
|---|---|---|---|---|---|---|
| | | (1) | (2) | (3) | (4) | (5) |
| Classification | | Comb-shaped polymer | Comb-shaped polymer | Comb-shaped polymer | Polymethacrylate | Polymethacrylate |
| Mw | | 600,000 | 370,000 | 430,000 | 440,000 | 410,000 |
| SSI | | 0.9 | 0.3 | 13.5 | 18.9 | 50.7 |
| Content of Constituent unit (mol %) | Methyl (meth)acrylate | 0 | 0 | 0 | 65 | 40 |
| | Butyl (meth)acrylate | 79 | 90 | 85 | 0 | 0 |
| | C12-18 Linear Alkyl (meth)acrylate | 12 | 0 | 0 | 0 | 0 |
| | C12-14 Linear Alkyl (meth)acrylate | 0 | 9 | 14 | 0 | 0 |
| | C16-18 Linear Alkyl (meth)acrylate | 0 | 0 | 0 | 20 | 0 |
| | C12-24 Linear Alkyl (meth)acrylate | 0 | 0 | 0 | 0 | 60 |
| | C24 Branched Alkyl (meth)acrylate | 0 | 0 | 0 | 15 | 0 |
| | Glyceric Acid (*1) | 8 | 0 | 0 | 0 | 0 |
| | Macromonomer (*2) | 1 | 1 | 1 | 0 | 0 |

(*1): Compound in which an unsaturated group is introduced into glyceric acid.

(*2): Macromonomer having Mn of 5000 to 6000 (content of isobutylene and/or 1,2-butylene in all the constituent units: 65 mol %)

Examples 1 to 2 and Comparative Examples 1 to 3

A paraffinic mineral oil, a viscosity index improver (1), (2), (3), (4) or (5), a pour-point depressant (1), and an additive package for an engine oil were blended in the amounts shown in Table 2, thereby preparing lubricating oil compositions, respectively. The content of the viscosity index improvers (1) to (5), the pour point depressant (1), and the additive package for an engine oil shown in Table 2 is the content of the active ingredient in terms of the active ingredient except for the diluent oil.

The details of the paraffinic mineral oil, the pour-point depressant, and the additive package for an engine oil, as used, are as follows, and the details of the viscosity index improvers (1) to (5) are shown in Table 1.

Paraffinic mineral oil: A paraffinic mineral oil classified into Group 3 of the API base oil category and having a kinematic viscosity at 100° C. of 4.2 $mm^2/s$, a viscosity index of 126, and a % $C_P$ of 79.6.

Pour-point depressant: Polymethacrylate having a weight average molecular weight (Mw) of 72,000.

Additive package for engine oil: An additive package adapted to the API/ILSAC standards and the SN/GF-5 standards and containing the following various additives.

Metal-based detergent: Calcium sulfonate

Dispersant: Macromolecular bisimide, boron-modified monoimide

Anti-wear agent: Primary ZnDTP and secondary ZnDTP

Antioxidant: Diphenylamine-based antioxidant, hindered phenol-based antioxidant, and sulfurized olefin Friction modifier: Fatty acid glyceride and oleic acid amide Anti-foaming agent: Silicone-based anti-foaming agent With respect to the prepared lubricating oil composition, various properties were measured according to the method described above, and the driving torque improving rate and anti-wear properties of each lubricating oil composition were also evaluated based on the method described below. The results are shown in Table 2.

(1) Measurement of Driving Torque Improving Rate

The main shaft of an SOHC (Single Overhead Camshaft) engine having an exhaust amount of 1.5 L was driven by a motor, and the torque applied to the main shaft was measured at that time. The rotational speed of the main shaft was set to 200 rpm, and the engine oil temperature and the water temperature were set to 80° C.

Taking a value of torque measured when the lubricating oil composition of Comparative Example 3 was used as a standard, a driving torque improving rate (%) in the case where a lubricating oil composition other than Comparative Example 3 was used was calculated based on the following equation.

[Driving torque improving rate](%)=([value of torque measured when the lubricating oil composition of Comparative Example 3 was used]−[value of torque measured when the lubricating oil composition to be measured was used])/[value of torque measured when the lubricating oil composition of Comparative Example 3 was used]×100

When the measured value of torque is smaller than that measured when the lubricating oil composition of Comparative Example 3 was used, the value of the driving torque improving rate calculated from the above formula is positive.

It could be regarded that as the value of the driving torque improving rate calculated from the above formula is larger, the driving torque is more improved, thereby causing the high fuel saving properties based on the lubricating oil composition measured.

In the present invention, when the value of the driving torque improving rate is "2.5% or more", the lubricating oil composition is determined to have high fuel saving properties, and the value of the driving torque improving rate is more preferably 3.0% or more, still more preferably 3.5% or more, and yet still more preferably 3.8% or more.

(2) Evaluation of Anti-Wear Properties

The value of the ratio [$H_{80}/H_{100}$] of the HTHS viscosity at 80° C., 1180 to the HTHS viscosity at 100° C., $H_{100}$ of the prepared lubricating oil composition was calculated. It could be regarded that as the value of the ratio [$H_{80}/H_{100}$] is higher, the lubricating oil composition is more excellent in anti-wear properties.

TABLE 2

| | | | Example 1 | Example 2 | Comparative Example 1 | Comparative Example 2 | Comparative Example 3 |
|---|---|---|---|---|---|---|---|
| Composition | Paraffinic mineral oil | % by mass | 88.40 | 88.20 | 88.55 | 87.25 | 87.20 |
| | Viscosity Index Improver (1) | % by mass | 1.88 | — | — | — | — |
| | Viscosity Index Improver (2) | % by mass | — | 2.00 | — | — | — |
| | Viscosity Index Improver (3) | % by mass | — | — | 1.83 | — | — |
| | Viscosity Index Improver (4) | % by mass | — | — | — | 1.89 | — |
| | Viscosity Index Improver (5) | % by mass | — | — | — | — | 2.12 |
| | Pour-point depressant | % by mass | 0.20 | 0.20 | 0.20 | 0.20 | 0.20 |
| | Additive package for engine oil | % by mass | 9.40 | 9.40 | 9.40 | 9.40 | 9.40 |
| | Total | % by mass | 100.00 | 100.00 | 100.00 | 100.00 | 100.00 |
| Various Properties | Kinematic viscosity at 80° C., $V_{80}$ | $mm^2/s$ | 11.0 | 11.1 | 12.1 | 11.9 | 13.2 |
| | Kinematic viscosity at 100° C. | $mm^2/s$ | 7.6 | 7.6 | 8.3 | 8.1 | 8.9 |
| | Viscosity index | — | 241 | 236 | 250 | 219 | 226 |
| | Oil film thickness at 80° C., $T_{80}$ | nm | 109 | 110 | 113 | 105 | 112 |
| | $V_{80}/T_{80}$ | $(mm^2/s)/nm$ | 0.101 | 0.101 | 0.107 | 0.113 | 0.117 |
| | HTHS viscosity at 80° C., $H_{80}$ | mPa · s | 7.2 | 7.4 | 7.6 | 7.2 | 7.6 |
| | HTHS viscosity at 100° C., $H_{100}$ | mPa · s | 4.8 | 5.0 | 5.2 | 4.7 | 5.1 |
| | HTHS viscosity at 150° C. | mPa · s | 2.6 | 2.6 | 2.6 | 2.6 | 2.6 |
| Evaluation | Driving torque improving rate | % | 3.8 | 3.6 | 2.0 | 2.3 | Standard |
| | Evaluation of anti-wear properties $H_{80}/H_{100}$ | — | 1.50 | 1.49 | 1.47 | 1.52 | 1.48 |

As compared with the lubricating oil compositions of Comparative Examples 1 to 3, the lubricating oil compositions prepared in Examples 1 and 2 had a high driving torque improving rate, and therefore, the lubricating oil compositions are excellent in fuel saving properties in the use in a temperature environment of around 80° C. which is assumed to fall within a range where an engine is practically used.

In addition, since the lubricating oil compositions prepared in Examples 1 and 2 each was high in the ratio of $H_{80}/H_{100}$, it is guessed that an oil film thereof would be sufficiently retained at around 80° C., thereby exhibiting excellent anti-wear properties.

The invention claimed is:

1. A lubricating oil composition, comprising:

a paraffinic mineral oil (A1) having a viscosity index of 100 or more and a paraffin content (% $C_P$) of 60 or more; and a viscosity index improver (B) selected from the group consisting of a polymethacrylate, a dispersion type polymethacrylate, an olefin-based copolymer, a dispersion type olefin-based copolymer, or a styrene-based copolymer and a comb-shaped polymer;

wherein the lubricating oil composition satisfies requirements (I), (II) and (III):

Requirement (I): a kinematic viscosity at 80° C., $V_{80}$ of the lubricating oil composition is 11.5 $mm^2/s$ or less;

Requirement (II): a ratio $[V_{80}/T_{80}]$ of a kinematic viscosity at 80° C., $V_{80}$ ($mm^2/s$) to an oil film thickness measured at a sliding speed of 2.0 m/s, a maximum Hertz pressure of 0.8 GPa, and an oil temperature of 80° C., $T_{80}$ (nm) of the lubricating oil composition is less than 0.105 (($mm^2/s$)/nm);

Requirement (III): a high-temperature high-shear viscosity (HTHS viscosity) at 80° C. of the lubricating oil composition is from 4.7 to 7.6 mPa·s.

2. The lubricating oil composition according to claim 1, wherein a kinematic viscosity at 100° C. of the paraffinic mineral oil (A1) is from 2.0 to 6.0 $mm^2/s$.

3. The lubricating oil composition according to claim 1, wherein a weight average molecular weight of the viscosity index improver (B) is from 200,000 to 800,000.

4. The lubricating oil composition according to claim 1, wherein a content of the viscosity index improver (B) is from 0.1 to 5.0% by mass on the basis of the whole amount of the lubricating oil composition.

5. The lubricating oil composition according to claim 1, wherein the viscosity index improver (B) contains a comb-shaped polymer (B1).

6. The lubricating oil composition according to claim 5, wherein the comb-shaped polymer (B1) has a constituent unit (X1) derived from a macromonomer (x1) having a number average molecular weight of 300 or more.

7. The lubricating oil composition according to claim 5, wherein the SSI (shear stability index) of the comb-shaped polymer (B1) is 12.0 or less.

8. The lubricating oil composition according to claim 1, wherein a ratio $[H_{80}/H_{100}]$ of an HTHS viscosity (high-temperature high-shear viscosity) at 80° C., $H_{80}$ to an HTHS viscosity at 100° C., $H_{100}$ is 1.40 or more.

9. A method comprising adding the lubricating oil composition according to claim 1 as an engine oil for an automobile engine equipped with at least one of a hybrid mechanism and an idling stop mechanism.

* * * * *